US010415515B2

(12) United States Patent
Grill et al.

(10) Patent No.: US 10,415,515 B2
(45) Date of Patent: Sep. 17, 2019

(54) EXHAUST GAS RECIRCULATION COOLER FOR AN INTERNAL COMBUSTION ENGINE

(71) Applicant: Mahle International GmbH, Stuttgart (DE)

(72) Inventors: Oliver Grill, Moetzingen (DE); Helmut Weiser, Tuebingen (DE)

(73) Assignee: Mahle International GmbH (DE)

( * ) Notice: Subject to any disclaimer, the term of this patent is extended or adjusted under 35 U.S.C. 154(b) by 19 days.

(21) Appl. No.: 15/782,812

(22) Filed: Oct. 12, 2017

(65) Prior Publication Data

US 2018/0106221 A1 Apr. 19, 2018

(30) Foreign Application Priority Data

Oct. 13, 2016 (DE) ..... 10 2016 220 017
Apr. 11, 2017 (DE) ..... 10 2017 206 201

(51) Int. Cl.
*F02M 26/28* (2016.01)
*F02M 26/32* (2016.01)
(Continued)

(52) U.S. Cl.
CPC ..... *F02M 26/29* (2016.02); *F02M 26/23* (2016.02); *F02M 26/28* (2016.02); *F02M 26/32* (2016.02);
(Continued)

(58) Field of Classification Search
CPC ..... F28D 7/1684; F28D 7/1692; F28F 1/122; F28F 1/124; F28F 9/0137; F28F 9/0265; F02M 26/28; F02M 26/29; F02M 26/32
(Continued)

(56) References Cited

U.S. PATENT DOCUMENTS 8,651,170 B2 2/2014 Maeda et al.
2003/0010479 A1* 1/2003 Hayashi ..... F01N 5/02 165/157
(Continued)

FOREIGN PATENT DOCUMENTS

DE 3212914 A1 10/1983
DE 19654366 A1 6/1998
(Continued)

OTHER PUBLICATIONS

English abstract for DE-3212914.
(Continued)

*Primary Examiner* — Erick R Solis
(74) *Attorney, Agent, or Firm* — Fishman Stewart PLLC

(57) ABSTRACT

An exhaust gas recirculation cooler may include a housing having a coolant inlet opening into an inlet region and a coolant outlet, and a plurality of cooling tubes arranged in the housing next to one another to form a tube row, each cooling tube connecting an exhaust gas inlet and outlet. At least two tube rows with one arranged on top of another and spaced from each other may form a tube block. Exhaust gas may be flowable through an inside of each cooling tube, and a coolant flow may be able to be circulated outside of the cooling tubes within the housing and flowable through an annular space enclosing the tube block in a circumferential direction. A flow guide arrangement for guiding the coolant in the interior of the tube block may be arranged in the housing lying against at least portions of one of the tube rows.

20 Claims, 6 Drawing Sheets

(51) Int. Cl.

| | |
|---|---|
| ***F02M 26/29*** | (2016.01) |
| ***F28D 7/16*** | (2006.01) |
| ***F28F 9/013*** | (2006.01) |
| ***F28F 1/12*** | (2006.01) |
| ***F02M 26/23*** | (2016.01) |
| ***F02M 26/33*** | (2016.01) |
| ***F28F 1/42*** | (2006.01) |
| ***F28F 9/00*** | (2006.01) |
| ***F28D 21/00*** | (2006.01) |
| *F28F 9/02* | (2006.01) |

(52) U.S. Cl.
CPC ..... *F02M 26/33* (2016.02); *F28D 7/1684* (2013.01); *F28D 7/1692* (2013.01); *F28D 21/0003* (2013.01); *F28F 1/122* (2013.01); *F28F 1/124* (2013.01); *F28F 1/426* (2013.01); *F28F 9/005* (2013.01); *F28F 9/0137* (2013.01); *F28F 9/0265* (2013.01)

(58) Field of Classification Search
USPC ..... 123/568.12
See application file for complete search history.

(56) References Cited

U.S. PATENT DOCUMENTS

| | | | | |
|---|---|---|---|---|
| 2007/0193732 | A1 | 8/2007 | Oofune et al. | |
| 2013/0074814 | A1* | 3/2013 | Schatz | F28F 3/025 123/568.12 |
| 2013/0327499 | A1 | 12/2013 | Goncalves | |
| 2015/0233649 | A1 | 8/2015 | Hughes et al. | |
| 2015/0260466 | A1 | 9/2015 | Grande Fernandez et al. | |
| 2017/0336147 | A1* | 11/2017 | Dieguez Fortes | F28D 7/0091 |
| 2018/0058389 | A1* | 3/2018 | DeLuca | F02M 26/29 |

FOREIGN PATENT DOCUMENTS

| | | | | |
|---|---|---|---|---|
| DE | 19961284 | A1 | 7/2001 | |
| DE | 102007005370 | A1 | 9/2007 | |
| DE | 102009038643 | A1 | 4/2010 | |
| DE | 102010001635 | A1 | 8/2011 | |
| DE | 102010008176 | A1 | 8/2011 | |
| DE | 102010013111 | A1 | 9/2011 | |
| DE | 112013004680 | T5 | 7/2015 | |
| DE | 102014208259 | A1 | 11/2015 | |
| DE | 202015009185 | U1 | 11/2016 | |
| FR | 2787875 | B1 | 6/2001 | |
| JP | 2000018877 | A | 1/2000 | |
| JP | 2008196319 | A | 8/2008 | |
| JP | 2014194296 | A | 10/2014 | |
| WO | 20150121148 | A1 | 8/2015 | |
| WO | WO 2017/157966 | * | 9/2017 | F02M 26/32 |

OTHER PUBLICATIONS

German search report dated Dec. 20, 2017.
English abstract for DE-19654366.
English abstract for DE-19961284.
English abstract for DE-102010001635.
English abstract for DE-102010008176.
English abstract for DE-102014208259.
English Abstract of FR2787875.
English Abstract of DE102010013111.
English Abstract of DE 202015009185.
German Search Report for DE 10 2017 206 201.0 dated Jan. 5, 2018.

* cited by examiner

EXHAUST GAS RECIRCULATION COOLER FOR AN INTERNAL COMBUSTION ENGINE

CROSS-REFERENCE TO RELATED APPLICATIONS

This application claims priority to German Patent Application No. 10 2016 220 017.8, filed on Oct. 13, 2016, and German Patent Application No. 10 2017 206 201.0, filed on Apr. 11, 2017, the contents of both of which are incorporated herein by reference in their entirety.

TECHNICAL FIELD

The invention relates to an exhaust gas recirculation cooler for an internal combustion engine, in particular of a motor vehicle.

BACKGROUND

In an exhaust gas recirculation cooler, the exhaust gas is cooled which is subsequently again fed to combustion chambers of an internal combustion engine together with the combustion air. In particular, the exhaust gas recirculation coolers are employed in motor vehicles with diesel engines in order to reduce exhaust gas emissions by recirculating the cooled exhaust gas into the combustion chambers.

For cooling the exhaust gas, a plurality of cooling tubes is arranged in a plurality of rows in a housing to form a tube bundle. The cooling tubes are mostly winglet tubes formed from stainless steel, in which flow obstructions for better heat transfer are integrally formed—for example by impressing. The exhaust gas flows through the winglet tubes and is cooled by a coolant flowing in the housing. An exhaust gas inlet and an exhaust gas outlet are generally accomplished by a diffuser, wherein the respective diffuser is connected to the housing and forms an interface to the customer connection.

Such exhaust gas recirculation coolers are known for example from DE 196 54 366 A1, DE 199 61 284 A1, DE 10 2007 005 370 A1, DE 10 2009 038 643 A1, DE 10 2010 001 635 A1, DE 10 2010 008 176 B4, DE 11 2013 004 680 T5, US 2013/0 327 499 A1, DE 10 2014 208 259 A1 and US 2015/0 260 466 A1.

In order to achieve a better heat transfer between the exhaust gas and the coolant, a longer and even exposure of the tube bundle to the coolant is aimed at. However since the quantity of the inflowing coolant is limited, a longer and even exposure of the tube bundle to the coolant in the conventional exhaust gas recirculation cooler is difficult to achieve.

SUMMARY

According to the invention, this object is solved through the subject of the independent claims. Advantageous embodiments are subject of the dependent claims.

The present invention is based on the general idea of diverting a coolant flowing into an exhaust gas recirculation cooler with as little loss as possible to a so-called exhaust gas inlet base and because of this achieve an increase of the heat transfer in the exhaust gas recirculation cooler between the hotter exhaust gas and the colder coolant. The exhaust gas recirculation cooler for this purpose comprises a housing in which a plurality of cooling tubes are arranged in columns next to one another to form a tube row and at least two tube rows on top of one another and spaced from one another to form a tube block. The respective cooling tube can be flowed through by the exhaust gas on the inside and gas-guidingly connects an exhaust gas inlet to an exhaust gas outlet. On the outside, a coolant flow can circulate about the respective cooling tube within the housing, for the purpose of which the housing comprises coolant inlet opening into the housing in an inlet region and a coolant outlet. The exhaust gas recirculation cooler also comprises an annular space enclosing the tube block in the circumferential direction, which can be flowed through by the coolant. According to the invention, the exhaust gas recirculation cooler comprises a flow guide arrangement for guiding the coolant in the interior of the tube block, which is arranged in the housing lying against at least one of the tube rows at least in certain areas.

The flow guide arrangement according to the invention lies against at least one of the tube rows. Accordingly, the flow guide arrangement can be arranged for example between the adjacent tube rows and comprise a plurality of guiding channels for guiding the coolant—such as for example water—between the respective adjacent tube rows. The guiding channels can guide the coolant from the inlet region of the housing between the two tube rows substantially in a transverse direction that is orthogonal to a longitudinal direction of the tube block and delay a draining of the coolant in the longitudinal direction, towards the coolant outlet. Accordingly, a longer and even exposure of the tube block in particular in the hotter inlet region to the coolant can be made possible and consequently the heat transfer between the coolant and the exhaust gas also improved. The flow guide arrangement can for example comprise at least one guide plate with guiding channels which are arranged between the adjacent tube rows and makes possible guiding the coolant substantially in the transverse direction.

Alternatively or additionally, the flow guide arrangement can lie against one or more tube rows on a side of the tube block facing the annular space and guide the coolant from the annular space between the adjacent tube rows. Accordingly, a draining of the coolant out of the inlet region from the coolant inlet to the coolant outlet about the tube block can be inhibited and a longer and even exposure of the tube block to the coolant made possible.

The flow guide arrangement can advantageously be arranged in the tube block already during the production of the exhaust gas recirculation cooler. Dependent on the dimensions of the exhaust gas recirculation cooler, the flow guide arrangement can also be suitably adapted. Through the flow guide arrangement according to the invention, the heat transfer in the exhaust gas recirculation cooler is increased and because of this a mechanical failure of the exhaust gas recirculation cooler as a consequence of overheating is advantageously prevented.

In an advantageous further development of the solution according to the invention it is provided that the flow guide arrangement comprises at least one flow guide structure, wherein the flow guide structure is arranged in the inlet region of the housing at least in certain areas and from the annular space engages in the tube block. Accordingly, the flow guide structure can advantageously delay a draining of the coolant about the tube block from the inlet region and make possible a guiding of the coolant between the adjacent tube rows substantially in the transverse direction. The flow guide arrangement can comprise a plurality of flow guide structures which engage from the annular space into the tube block on one side or both sides located opposite. The flow behaviour of the coolant in the annular space and in the tube block in this case can be advantageously influenced by the number, the arrangement of the flow guide structures on the tube block, the dimensions and the configuration of the flow guide structures.

In order to facilitate fixing the flow guide structure on the tube block, the flow guide structure can engage about at least one of the tube rows at least in some areas on a side facing the annular space. The flow guide structure can be arranged for example in a clamping or form-fit manner on one of the tube rows and from the annular space engage into intermediate spaces to the adjacent tube rows. Here, the flow guide structure can engage about a plurality or individual tube rows and the flow pattern of the coolant in the tube block and in the annular space can thereby be influenced.

Advantageously it is provided that the flow guide structure comprises at least one fixing region for fixing the flow guide structure on the tube row and at least one flow guide region for guiding the coolant between the adjacent tube rows. The fixing region can fix the flow guide structure on the tube row for example in a form-fit or force-fit manner. Because of this, the assembly expenditure of the flow guide structure on the tube block can be substantially reduced in particular. By way of the flow guide region, the coolant is guided through the tube block, wherein the flow guide region is arranged in the inlet region of the housing and thus makes possible guiding the coolant even from the coolant inlet in the tube block. Through the number, the arrangement on the tube block, the dimensions and the configuration of the flow guide structures, the flow pattern of the coolant in the annular space and in the tube block can be advantageously influenced.

In a particularly advantageous manner, the fixing region and/or the flow guide region of the flow guide structure can be clamped in between two adjacent tube rows. Because of this, an undesirable shifting of the flow guide structure within the tube block can be prevented and a particularly secure fixing of the flow guide structure in the tube block be achieved.

In order to further increase the heat transfer in the coolant and the exhaust gas it is advantageously provided that the flow guide region deflects the coolant flowing in from the coolant inlet to the exhaust gas inlet—i.e. to the so-called exhaust gas inlet base. At the exhaust gas inlet, the exhaust gas to be cooled has the highest temperature and the coolant flowing in from the coolant inlet has the lowest temperature within the housing. By diverting the coolant, a high temperature gradient between the coolant and the exhaust gas is achieved at the exhaust gas inlet and consequently the heat transfer advantageously increased. To this end, the flow guide region can comprise at least one guiding channel which is arranged substantially transversely to the longitudinal direction of the tube block and thus makes possible a diverting of the coolant to the exhaust gas inlet. The guiding channel can extend over the entire width or alternatively only partly into the width of the tube block. The angle of the guiding channel to the longitudinal direction or to the transverse direction of the tube block can also be adapted in order to influence the flow pattern of the coolant in the tube block.

In a particularly advantageous further development of the flow guide structure it is provided that the flow guide structure comprises at least one wire element. The wire element in this case can be an injection moulded part, an injection moulding or a formed wire part. The wire element advantageously has a low volume and reduces the volume of the coolant flowing in the housing only negligibly. Accordingly, the coolant is advantageously guided in the tube block and the volume of the coolant in the housing is retained. Advantageously, the wire element also has only a minor effect on the pressure loss in the coolant flow. Furthermore, the wire element can be produced cost-effectively.

Advantageously it is provided, furthermore, that the fixing region and the flow guide region are integrally formed on the wire element. Accordingly, the fixing region can be formed for example meander-like or clamp-like and make possible a force-fit fixing of the flow guide structure on the tube block. A form-fit fixing of the fixing region for example on stampings of the cooling tubes is likewise possible. The flow region can be shaped in the form of a longer guiding channel which substantially extends in the transverse direction. By adapting the length of the guiding channel or the angle to the transverse direction of the tube block, the flow pattern of the coolant in the tube block can be advantageously influenced.

In order to be able to cool the exhaust gas inlet as effectively as possible it is provided that the flow guide arrangement has a ring structure. Here, the ring structure is arranged in the annular space about the tube block and separates the inlet region within the annular space in a fluid-inhibiting manner at least in some areas from the coolant outlet. Accordingly, a draining of the coolant about the tube block from the inlet region is advantageously inhibited and the heat transfer in the inlet region improved. The annular structure can be arranged for example in a recess of the housing and thus fixed on the housing. Alternatively, the ring structure can be fixed on a recess of the housing.

It is also provided that the ring structure comprises at least one passage opening through which the coolant can flow from the inlet region within the annular space to the coolant outlet. The passage opening can be provided for example on a lateral surface or on an angled region of the ring structure in order to make possible at least partly a draining of the coolant from the inlet region. In particular, a damming-up of the coolant and thus an overheating in the inlet region can thereby be prevented and the coolant pressure in the housing be maintained.

The ring structure can be advantageously fixed on the tube block and/or on the housing in a resilient and/or preloaded manner. To this end, the ring structure can for example comprise resilient structures formed on the ring structure in its longitudinal direction, which can advantageously protect the ring structure from mechanical loads such as for example vibrations.

In a further development of the solution according to the invention it is advantageously provided that the housing has a circulation space, wherein the circulation space encloses the tube block in the inlet region in the circumferential direction and is formed for example by a recess in the housing. In the circulation space, the coolant can be collected prior to the guiding in the tube block and the tube block additionally cooled in the inlet region. From the circulation space, the coolant can be subsequently guided between the tube rows in order to cool the exhaust gas. In this way, an even exposure of the tube block to the coolant can be achieved and consequently the heat transfer between the coolant and the exhaust gas in the inlet region increased.

Advantageously it is provided that the flow guide arrangement comprises the ring structure and at least one flow guide structure and that at least one of the flow guide structures is integrally formed on the ring structure. The flow guide structure integrally formed on the ring structure can be configured in a particularly stable manner and because of this the lifespan of the flow guide arrangement increased.

Alternatively it is provided that the flow guide arrangement comprises the ring structure and at least one flow guide structure, wherein the ring structure engages about at least one of the flow guide structures arranged on the tube block. Here, the flow guide structures can be first arranged in the tube block and subsequently the ring structure arranged about the tube block.

Further important features and advantages of the invention are obtained from the subclaims, from the drawings and from the associated figure description by way of the drawings.

It is to be understood that the features mentioned above and still to be explained in the following cannot only be used in the respective combination stated but also in other combinations or by themselves without leaving the scope of the present invention.

Preferred exemplary embodiments of the invention are shown in the drawing and are explained in more detail in the following description, wherein same reference characters relate to same or similar or functionally same components.

BRIEF DESCRIPTION OF THE DRAWINGS

It shows, in each case schematically

DETAILED DESCRIPTION

Figure 1:
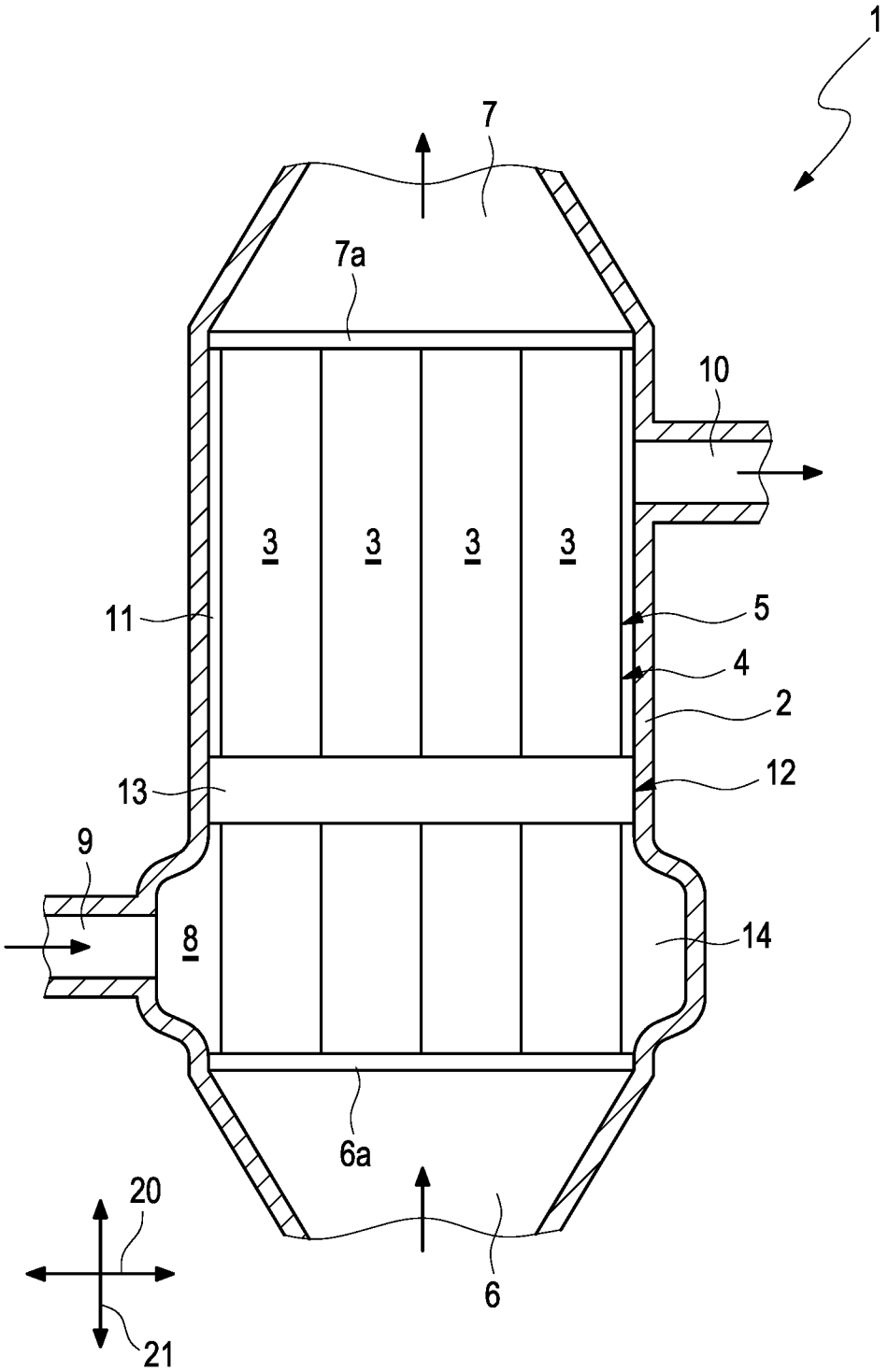
FIG. 1 a part sectional view of an exhaust gas recirculation cooler according to the invention.

FIG. 1 shows a part sectional view of an exhaust gas recirculation cooler 1 according to the invention. The exhaust gas recirculation cooler 1 comprises a housing 2 in which a plurality of cooling tubes 3 are arranged in columns next to one another to form a tube row 4 and at least two tube rows 4 on top of one another and spaced from one another to form a tube block 5. The respective cooling tube 3 can be flowed through by exhaust gas on the inside and gas-guidingly connects an exhaust gas inlet 6 to an exhaust gas outlet 7. The individual cooling tubes 3 are connected in a fluid-tight manner on the exhaust gas inlet 6 with an exhaust gas inlet base 6*a* and on the exhaust gas outlet 7 with an exhaust gas outlet base 7*a*. On the outside, the coolant flow can circulate about the respective cooling tube 3 within the housing 2, for the purpose of which the housing 2 comprises a coolant inlet 9 which opens into the housing 2 in an inlet region 8 and a coolant outlet 10. The exhaust gas recirculation cooler 1 also comprises an annular space 11 enclosing the tube block 5 in the circumferential direction, which can be flowed through by the coolant. According to the invention, the exhaust gas recirculation cooler 1 comprises a flow guide arrangement 12 for guiding the coolant in the interior of the tube block 5, which is arranged in the housing 2 lying against at least one of the tube rows 3 at least in certain areas. In this exemplary embodiment, the flow guide arrangement 12 has a ring structure 13 which is arranged about the tube block 5 in the annular space 11. The ring structure 13 separates in a fluid-tight manner the inlet region 8 within the annular space 11 from the coolant outlet 10, so that a draining of the coolant about the tube block 5 from the inlet region 8 is prevented and the heat transfer in the inlet region 8 is improved. To further improve the heat transfer between the exhaust gas and the coolant, the housing 2 comprises a circulation space 14 which encloses the tube block 5 in the inlet region 8 in the circumferential direction.

Figure 2:
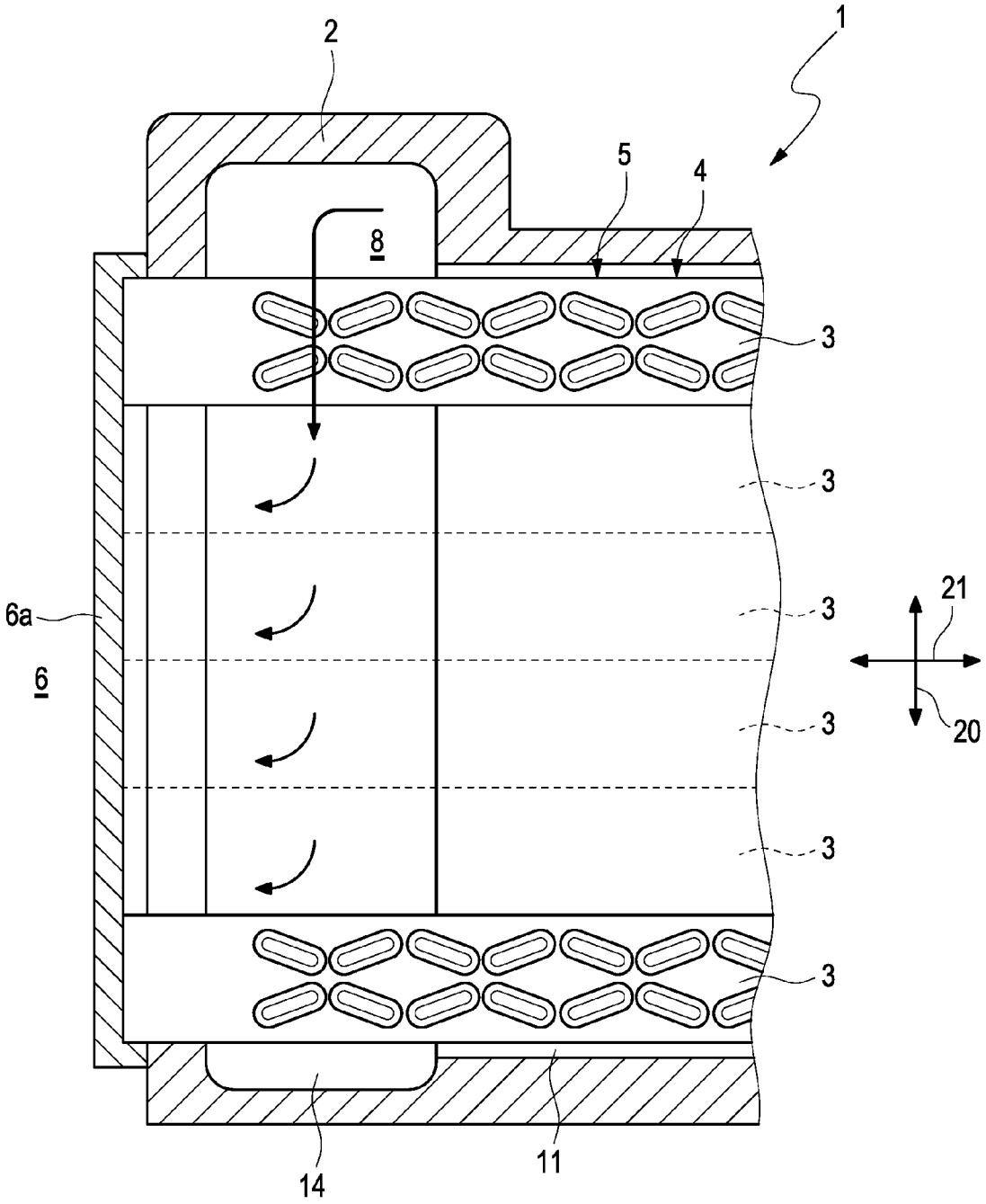
FIG. 2 a part sectional view of an exhaust gas recirculation cooler with a circulation space.

FIG. 2 shows a part sectional view of the exhaust gas recirculation cooler 1 with the circulation space 14. For the sake of clarity, the middle cooling tubes 3 in the tube row 4 are shown in dashed lines. In the circulation space 14, the coolant is dammed up prior to it being guided to the exhaust gas inlet 6 and the tube block in the inlet region 8 is cooled longer. From the circulation space 14, the coolant can subsequently be guided into the tube block 5—as indicated by arrows. In this way, an even exposure of the tube block 5 to the coolant can be achieved and consequently the heat transfer between the coolant and the exhaust gas in the inlet region 8 increased.

Figure 3:
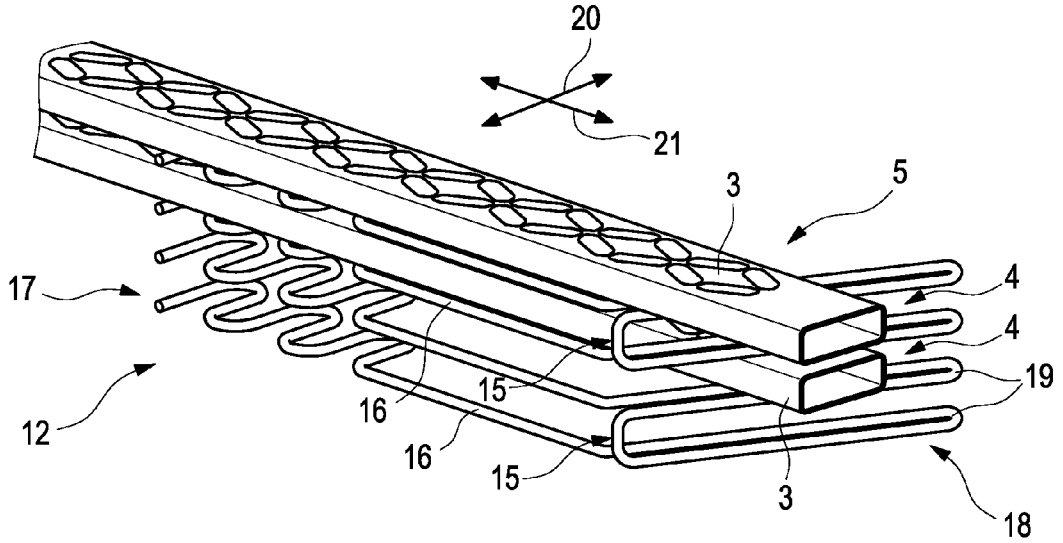
FIG. 3 a view of a flow guide arrangement that is arranged on a tube block.
Figure 4:
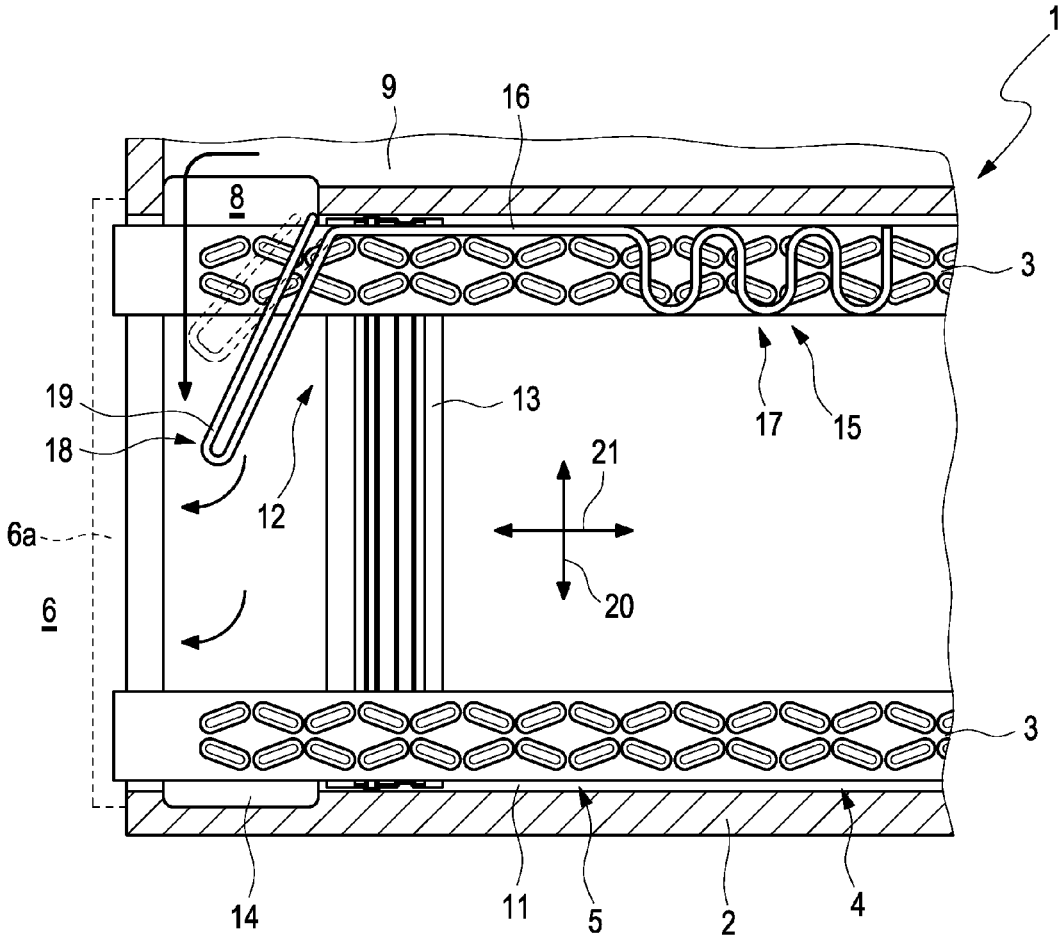
FIG. 4 a plan view of a flow guide arrangement which is arranged on a tube block.

FIG. 3 shows a view and FIG. 4 a plan view of the flow guide arrangement 12 which is arranged on the tube block 5. The flow guide arrangement 12 comprises two flow guide structures 15 which in this exemplary embodiment are via elements. The flow guide structures 15 can be arranged in certain areas in the inlet region 8 of the housing 2 and from the annular space 11 engage in the tube block 5. The flow guide structures 15 each have a fixing region 17 for fixing the respective flow guide structure 15 on the respective tube row 4 and a flow guide region 18 for guiding the coolant between the adjacent tube rows 4. The fixing region 17 engages about the respective tube row 4 and clampingly fixes the flow guide structure 15 on the tube block 5.

In order to increase the heat transfer between the coolant and the exhaust gas, the flow guide region 18 diverts the coolant flowing in from the coolant inlet 9 to the exhaust gas inlet 6. The flow region 18 of the respective flow guide structure 15 to this end comprises two guiding channels 19 which substantially extend in a transverse direction 20 to a longitudinal direction 21 of the tube block 5. The respective guiding channel 19 has—as is visible in FIG. 4—an angle to the transverse direction 20 and can divert the coolant to the exhaust gas inlet 6 and to the exhaust gas inlet base 6*a*. The angle of the guiding channel 19 to the transverse direction 20 or to the longitudinal direction 21 of the tube block 5 and the length of the guiding channel 19 can be adapted in order to influence the flow pattern of the coolant in the tube block 5. By diverting the coolant, the flow guide structure 15 delays a draining of the coolant from the inlet region 8 so that the heat transfer between the coolant and the exhaust gas can be increased.

Figure 5:
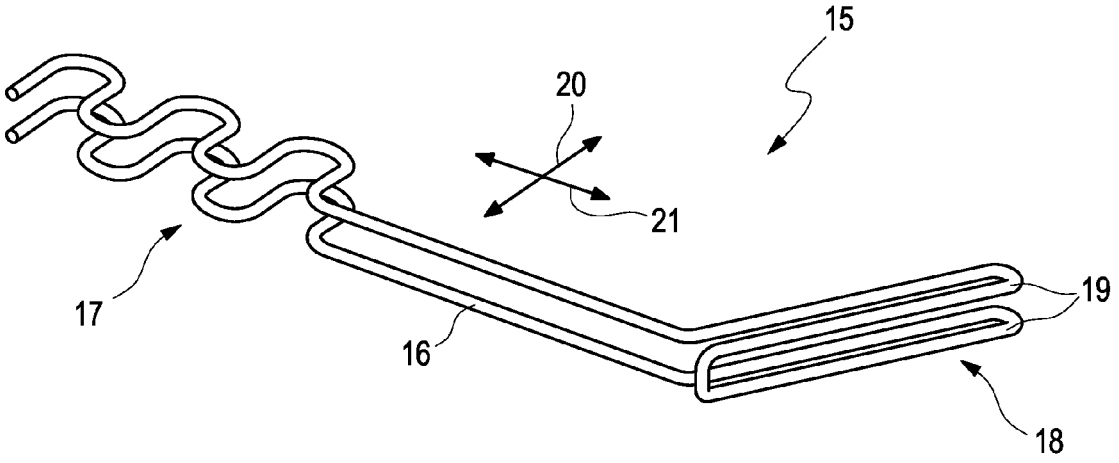
FIG. 5 a view of a flow guide structure.
Figure 6:
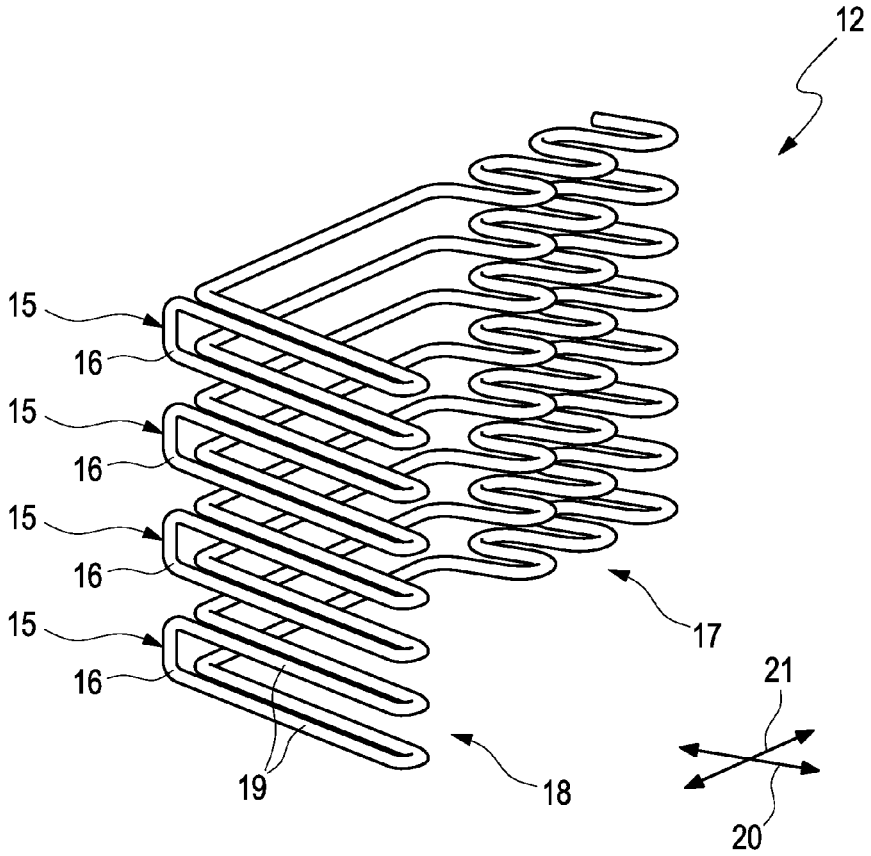
FIG. 6 a view of a plurality of flow guide structures which are arranged to form a flow guide arrangement.

In FIG. 5, a single wire element 16 of the flow guide structure 15 and in FIG. 6 a total of four wire elements 16 of the flow guide structure 15 to the flow guide structure 12 are arranged. Here, the respective wire element 16 can for example be an injection moulded part and injection moulding or a wire formed part. The fixing region 17 and the flow guide region 18 are integrally formed on the wire element 16. Accordingly, the wire element 16 can be produced cost-effectively. The fixing region 17 of the wire element 16 is formed meander-like and makes possible a force-fit fixing of the wire element 16 on the tube row 4. The flow guide region 18 of the wire element 16 comprises two guiding channels 19 through which guiding the coolant in each case between the adjacent tube rows 4 is made possible. The flow pattern of the coolant in the tube block 5 can be advantageously influenced by changing the length and the width of the guiding channel 19 and the angle to the transverse direction 20.

Figure 7:
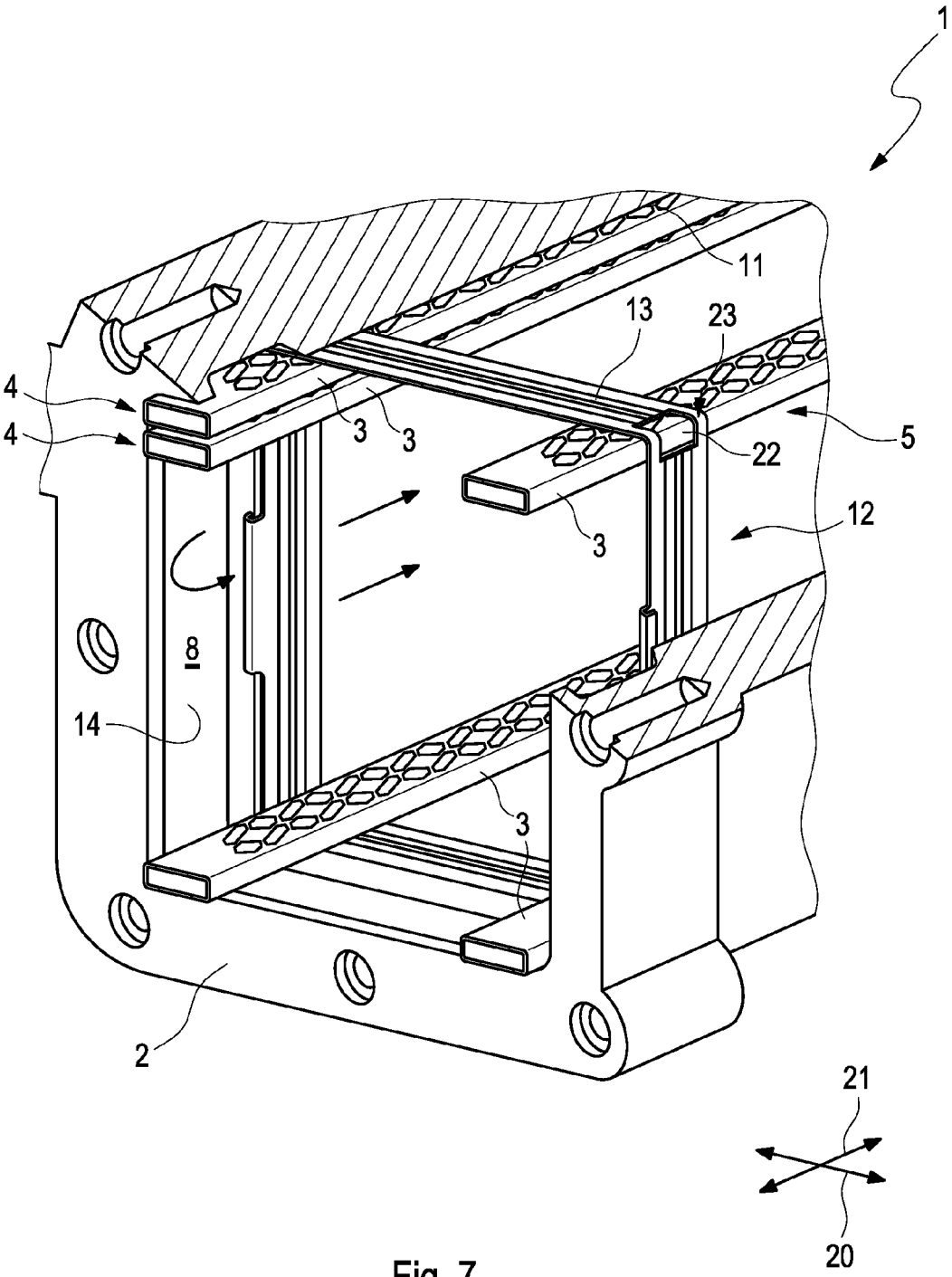
FIG. 7 a view of an exhaust gas recirculation cooler with a ring structure.

FIG. 7 shows a view of the exhaust gas recirculation cooler 1 with the ring structure 13 of the flow guide arrangement 12. Here, the ring structure 13 is arranged in the annular space 11 about the tube block 5 and fluid-inhibitingly separates the inlet region 8 within the annular space 11 from the coolant outlet 10. Accordingly, a draining of the coolant about the tube block 5 from the inlet region 8 is advantageously inhibited and the heat transfer in the inlet region 8 improved. In order to prevent damming-up of the coolant and thus an overheating in the inlet region 8, the ring structure 13 comprises at least one passage opening 22. The passage opening 22 is arranged in an angled region 23 of the ring structure 13 and makes possible a draining of the coolant from the inlet region 8 within the annular space 11. In order to influence the draining of the coolant from the inlet region 8, the ring structure 13 can comprise a plurality of passage openings 22 which differ in the size and in the position.

Figure 8:
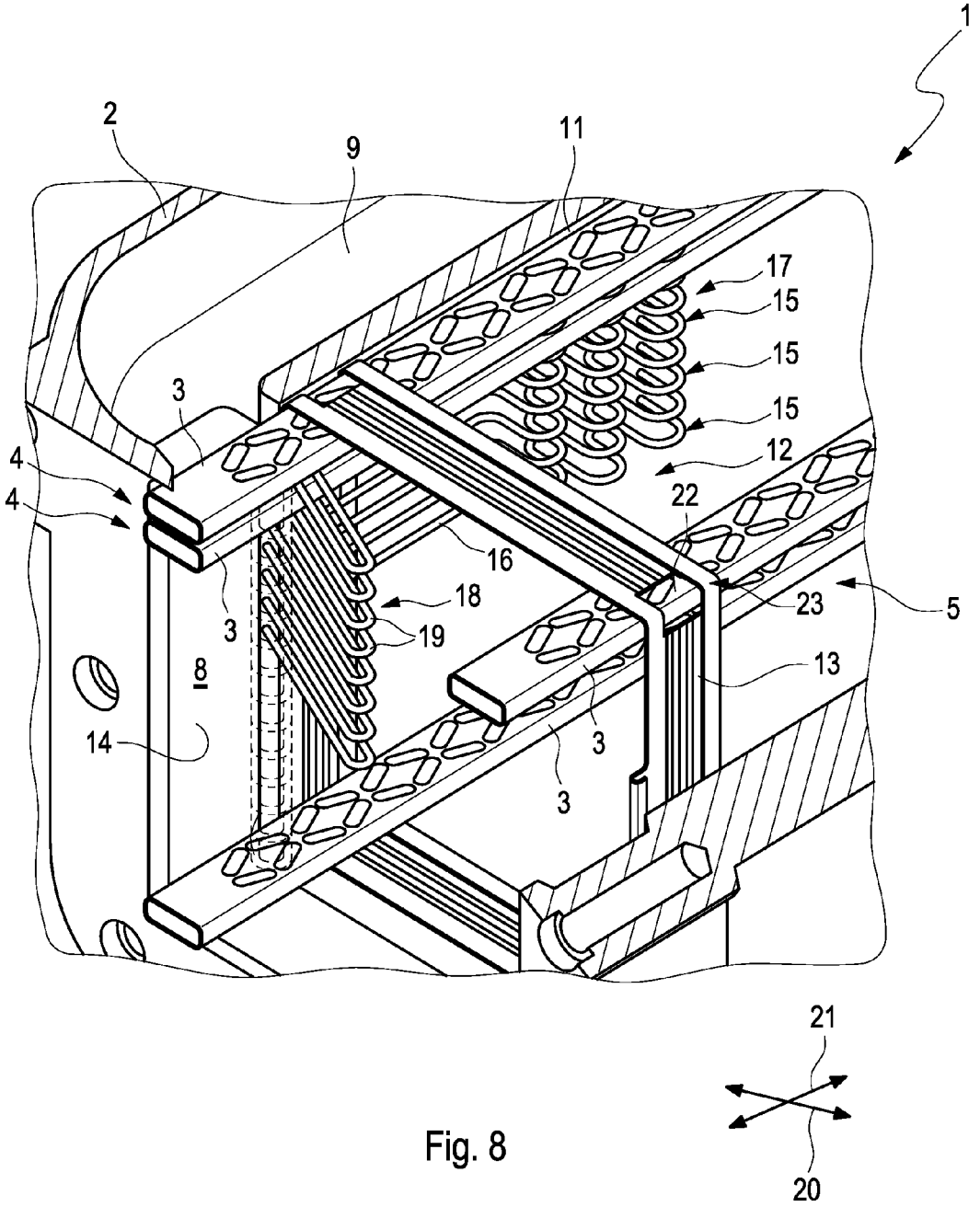
FIG. 8 a view of an exhaust gas recirculation cooler with a ring structure and with a plurality of flow guide structures.

In FIG. 8, a view of the exhaust gas recirculation cooler 1 with the flow guide arrangement 12 is shown, which comprises the ring structure 13 and the flow guide structures 15. The ring structure 13 engages about the flow guide structures 15 arranged on the tube block 5, as a result of which an additional fixing of the flow guide structure 15 in the tube block 5 is made possible.

The flow guide arrangement 12 can be arranged in the tube block 5 for example even during the production of the exhaust gas recirculation cooler 1. Dependent on the dimensions of the exhaust gas recirculation cooler 1, the flow guide arrangement 12 can also be suitably adapted. By way of the flow guide arrangement 12, the heat transfer in the exhaust gas recirculation cooler 1 according to the invention is improved and because of this a mechanical failure of the exhaust gas recirculation cooler 1 as a consequence of an overheating advantageously prevented and also the efficiency of the exhaust gas recirculation cooler 1 increased.

The invention claimed is:

1. An exhaust gas recirculation cooler for an internal combustion engine, comprising:

a housing having a coolant inlet opening into an inlet region in the housing, and a coolant outlet; and a plurality of cooling tubes arranged in the housing next to one another to form a tube row, each of the plurality of cooling tubes connecting an exhaust gas inlet and an exhaust gas outlet;

wherein the tube row includes at least two tube rows with one arranged on top of another and spaced from each other to form a tube block;

wherein exhaust gas is flowable through an inside of each of the plurality of cooling tubes, and a coolant flow is able to be circulated outside of the cooling tubes within the housing and is flowable through an annular space enclosing the tube block in a circumferential direction;

wherein a flow guide arrangement for guiding the coolant in the interior of the tube block is arranged in the housing lying against at least portions of one of the at least two tube rows; and wherein the flow guide arrangement includes a flow guide structure arranged in at least a portion of the inlet region of the housing and engaging the tube block, and the flow guide structure includes a wire element.

2. The exhaust gas recirculation cooler according to claim 1, wherein the flow guide structure engages about at least one of the tube rows on a side facing the annular space at least in certain areas.

3. The exhaust gas recirculation cooler according to claim 1, wherein the flow guide structure includes at least one fixing region for fixing the flow guide structure on a respective one of the tube rows, and at least one flow guide region for guiding the coolant between adjacent tube rows.

4. The exhaust gas recirculation cooler according to claim 3, wherein at least one of the fixing region and the flow guide region of the flow guide structure is clamped in between the adjacent tube rows.

5. The exhaust gas recirculation cooler according to claim 3, wherein the flow guide region diverts the coolant flowing in from the coolant inlet to the exhaust gas inlet.

6. The exhaust gas recirculation cooler according to claim 3, wherein the fixing region and the flow guide region are integrally formed on the wire element.

7. The exhaust gas recirculation cooler according to claim 1, wherein the wire element is one of an injection molded part, an injection molding, or a wire formed part.

8. The exhaust gas recirculation cooler according to claim 1, wherein the flow guide arrangement includes a ring structure arranged in the annular space about the tube block, the ring structure separating the inlet region within the annular space from the coolant outlet in a fluid-tight manner at least in certain areas.

9. The exhaust gas recirculation cooler according to claim 8, wherein the ring structure includes at least one passage opening through which the coolant is flowable from the inlet region within the annular space to the coolant outlet.

10. The exhaust gas recirculation cooler according to claim 8, wherein the ring structure is fixed on at least one of the tube block and the housing in at least one of a resilient manner and a preloaded manner.

11. The exhaust gas recirculation cooler according to claim 1, wherein the housing includes a circulation space that encloses the tube block in the inlet region in the circumferential direction.

12. The exhaust gas recirculation cooler according to claim 8, wherein the flow guide arrangement includes the ring structure and the flow guide structure, wherein the flow guide structure is integrally formed on the ring structure.

13. The exhaust gas recirculation cooler according to claim 8, wherein the flow guide arrangement includes the ring structure and the flow guide structure, wherein the ring structure engages about the flow guide structure arranged on the tube block.

14. An exhaust gas recirculation cooler for an internal combustion engine, comprising:

a housing having a coolant inlet opening into an inlet region in the housing, and a coolant outlet;

a plurality of cooling tubes arranged in the housing next to one another to form a tube row, each of the plurality of cooling tubes connecting an exhaust gas inlet and an exhaust gas outlet;

wherein the tube row includes at least two tube rows with one arranged on top of another and spaced from each other to form a tube block; and wherein exhaust gas is flowable through an inside of each of the plurality of cooling tubes, and a coolant flow is able to be circulated outside of the plurality of cooling tubes within the housing and is flowable through an annular space enclosing the tube block in a circumferential direction;

wherein a flow guide arrangement for guiding the coolant in the interior of the tube block is arranged in the housing lying against at least portions of one of the at least two tube rows; and wherein the flow guide arrangement includes a wire element and a ring structure arranged in the annular space about the tube block, the ring structure separating the inlet region within the annular space from the coolant outlet in a fluid-tight manner at least in certain areas.

15. The exhaust gas recirculation cooler according to claim 14, wherein the ring structure includes at least one passage opening through which the coolant is flowable from the inlet region within the annular space to the coolant outlet.

16. The exhaust gas recirculation cooler according to claim 14, wherein the ring structure is fixed on at least one of the tube block and the housing in at least one of a resilient manner and a preloaded manner.

17. The exhaust gas recirculation cooler according to claim 14, wherein the flow guide arrangement includes the ring structure and at least one flow guide structure, wherein the at least one flow guide structure is integrally formed on the ring structure.

18. The exhaust gas recirculation cooler according to claim 14, wherein the flow guide arrangement includes the ring structure and at least one flow guide structure, wherein the ring structure engages about the at least one flow guide structure arranged on the tube block.

19. An exhaust gas recirculation cooler, comprising:

a housing having a coolant inlet and a coolant outlet; and a plurality of cooling tubes arranged in the housing with at least two tube rows forming a tube block and connecting an exhaust gas inlet and an exhaust gas outlet, wherein exhaust gas is flowable through an inside of the plurality of cooling tubes, and a coolant flow is able to be circulated outside of the plurality of cooling tubes and is flowable through an annular space enclosing the tube block in a circumferential direction, wherein a flow guide arrangement for guiding the coolant in the interior of the tube block is arranged in the housing, and wherein the flow guide arrangement includes a wire element arranged in at least a portion of the inlet region of the housing and engaging the tube block.

20. The exhaust gas recirculation cooler of claim 19, wherein the wire element is one of an injection molded part, an injection molding, or a wire formed part.

* * * * *